US005217747A

United States Patent [19]

Tsantrizos et al.

[11] Patent Number: 5,217,747

[45] Date of Patent: Jun. 8, 1993

[54] REACTIVE SPRAY FORMING PROCESS

[75] Inventors: Peter G. Tsantrizos, Ville St-Pierre; Lakis T. Mavropoulos, Montreal; Boulos Maher; Jerzy Jurewicz, both of Sherbrooke; Bruce Henshaw, Rigaud; Raynald Lachance, Pincourt; Kaiyi Chen, Sherbrooke, all of Canada

[73] Assignee: Noranda Inc., Toronto, Canada

[21] Appl. No.: 660,009

[22] Filed: Feb. 25, 1991

[30] Foreign Application Priority Data

Feb. 26, 1990 [CA] Canada ..... 2010887

[51] Int. Cl.[5] ..... B05D 1/06; B05D 1/00; B23K 9/00

[52] U.S. Cl. ..... 427/455; 427/576; 219/121.47; 75/346; 75/351

[58] Field of Search ..... 427/34, 38, 39; 219/121.47; 75/346, 351

[56] References Cited

U.S. PATENT DOCUMENTS

| | | | |
|---|---|---|---|
| 3,698,936 | 10/1972 | Moltzan | 427/423 |
| 3,961,098 | 6/1976 | Bessen | 427/34 |
| 4,436,762 | 3/1984 | Lapatovich et al. | 427/39 |
| 4,505,949 | 3/1985 | Jelks | 427/38 |
| 4,518,624 | 5/1985 | Park et al. | 427/34 |
| 4,540,607 | 9/1985 | Tsao | 427/38 |
| 4,670,290 | 6/1987 | Itoh et al. | 427/34 |
| 4,788,402 | 11/1988 | Browning | 427/34 |
| 4,818,837 | 4/1989 | Pfender | 427/34 |
| 4,970,091 | 11/1990 | Buhrmaster et al. | 427/34 |

*Primary Examiner*—Marianne Padgett
*Attorney, Agent, or Firm*—Keck, Mahin & Cate

[57] ABSTRACT

A reactive spray forming process comprises generating a molten spray of metal, and reacting such molten spray of metal in flight with a surrounding hot metal halide gas to form a desirable alloy, intermetallic or composite product. The molten spray of metal may be directed towards a cooled substrate and the alloy, intermetallic or composite product collected and solidified on the substrate.

10 Claims, 3 Drawing Sheets

REACTIVE SPRAY FORMING PROCESS

This invention relates to a reactive spray forming process capable of synthesizing, alloying and forming materials in a single unit operation.

Almost all of our materials today are manufactured from their precursor chemicals through a sequence of three distinct classes of unit operations. The first class involves the production of relatively pure materials. The second class consists of mixing various pure materials together to form the desired alloys. Finally, the alloys thus produced are formed into useful products. For example, a sheet of 90-6-4 Ti-Al-V alloy is currently produced by reducing $TiCl_4$ with magnesium or sodium to produce pure titanium sponge, alloying the titanium with the proper amounts of aluminum and vanadium, and forming the alloy into a sheet. Due to the extreme reactivity of molten titanium, the synthesis, alloying and forming operation are very complex and result in the contamination of the final product. In fact, over half of the pure titanium produced today becomes too contaminated for its intended use and must be either disposed as waste or marketed in low value applications. Not surprisingly, the alloyed sheets are very expensive when considering the abundance of the raw materials used in making them. Although improvements in each of the three classes of unit operations are being pursued, the overall cost of producing such sheets can not be decreased significantly as long as the sequence of operations is maintained.

There are very few known processes which are capable of synthesizing, and forming materials in a single unit operation. Chemical Vapor Deposition (CVD) is such a process. In CVD two gaseous precursor chemicals react to form the desired compound which is then deposited and solidified onto a cold substrate. For example, $TiCl_4$ and $NH_3$ may react to form TiN and HCl. The TiN can then be deposited onto a substrate to form a ceramic coating. The CVD process is commonly used for the production of coatings. However the rate of generation of materials by CVD is so low that the process is limited to the deposition of thin coatings and cannot be used for the production of near net shape deposits or structural materials.

A process capable of higher production rates than CVD has been demonstrated for the production of reactive metals by Westinghouse Electric Corp. (U.S.A.). In this process an inert plasma gas provides the needed activation energy for the exothermic reaction of a reducing vapor (e.g. sodium) and a vapor metal chloride (e.g. $TiCl_4$). The very fine powder of the metal thus produced can be collected in a molten bath. Unfortunately, the sub-micron powders are difficult to collect, no known material can hold a molten bath of a reactive metal, and conventional forming operations must be utilized to produce the final net-shape product. Thus, the advantages offered by these plasma processes are marginal and the process has never been commercialized.

Droplets of molten metal can be formed into useful net-shape products by a conventional process known as spray-forming. In a spray-forming process, a molten metal alloy, having precisely the composition desired for the final product, is atomized with inert gas in a two fluid atomizer. The molten spray, consisting of droplets between 20 and 150 microns in diameter, is projected onto a substrate. While in flight, the droplets gradually cool and partially solidify into a highly viscous state. On the substrate the droplets splatter, bond with the materials below them and fully solidify. As the droplets pile on top of each other, they form a solid structure of fine grain size (due to the high solidification rates) and relatively low porosity (92% to 98% of full density). By controlling the movement of both the substrate and the atomizing nozzle, various mill products (billets, sheets, tubes, etc.) can be produced. Reactive metals can not be spray-formed effectively due to difficulties of generating a reactive metal spray. Spray-forming does not include synthesis of materials.

Another variation of the spray-forming technology is plasma spraying. In this process, a powder of the desired composition is introduced into the fire ball of an inert plasma. In the plasma, the powder melts quickly, forming a spray of molten material similar to that formed with the conventional two-fluid atomization process, and is projected onto a relatively cool substrate. The events occurring on the substrate are essentially the same for conventional spray-forming and for plasma spraying. The feed rates of plasma spraying are about two orders of magnitude lower than those of spray-forming. Furthermore, plasma spraying needs expensive powder as its feed. Thus, plasma spraying is most suitable for the application of coatings or for the production of small net-shape articles. However, almost all materials can be plasma sprayed assuming the proper powder is available. Plasma spraying does not include materials synthesis.

It is the object of the present invention to provide a process which is capable of synthesizing, alloying and forming materials in a single unit operation.

The process in accordance with the present invention comprises generating a molten spray of a metal and reacting the molten spray of metal in flight with a surrounding hot metal halide gas resulting in the formation of a desirable alloy, intermetallic, or composite product. The molten spray of metal may be directed towards a cooled substrate and the alloy, intermetallic, or composite product collected and solidified on the substrate. Alternatively, the reacted molten product may be cooled and collected as a powder.

Many variations of the reactive spray forming process are possible. Three such variations are described herein. In the first two versions a plasma torch is used to melt powders of the reducing metal (e.g. aluminum). These molten powders can then react with the hot metal halide gas (e.g. $TiCl_4$) to synthesize the desirable alloy. In both versions, the metal halide gas can either be introduced as the main plasmagas or be injected in the tail flame of an inert plasma. The difference between the first two versions is the type of plasma generating device used. A d.c. plasma torch was used in the first version whereas an induction torch was used in the second version. In the third version of the reactive spray forming process, the molten reactive spray is generated in a two-fluid atomizing nozzle. The liquid and gaseous reactants are used as the two fluids in the atomizer.

The invention will now be disclosed, by way of example, with reference to the accompanying drawings in which.

Figure 1:
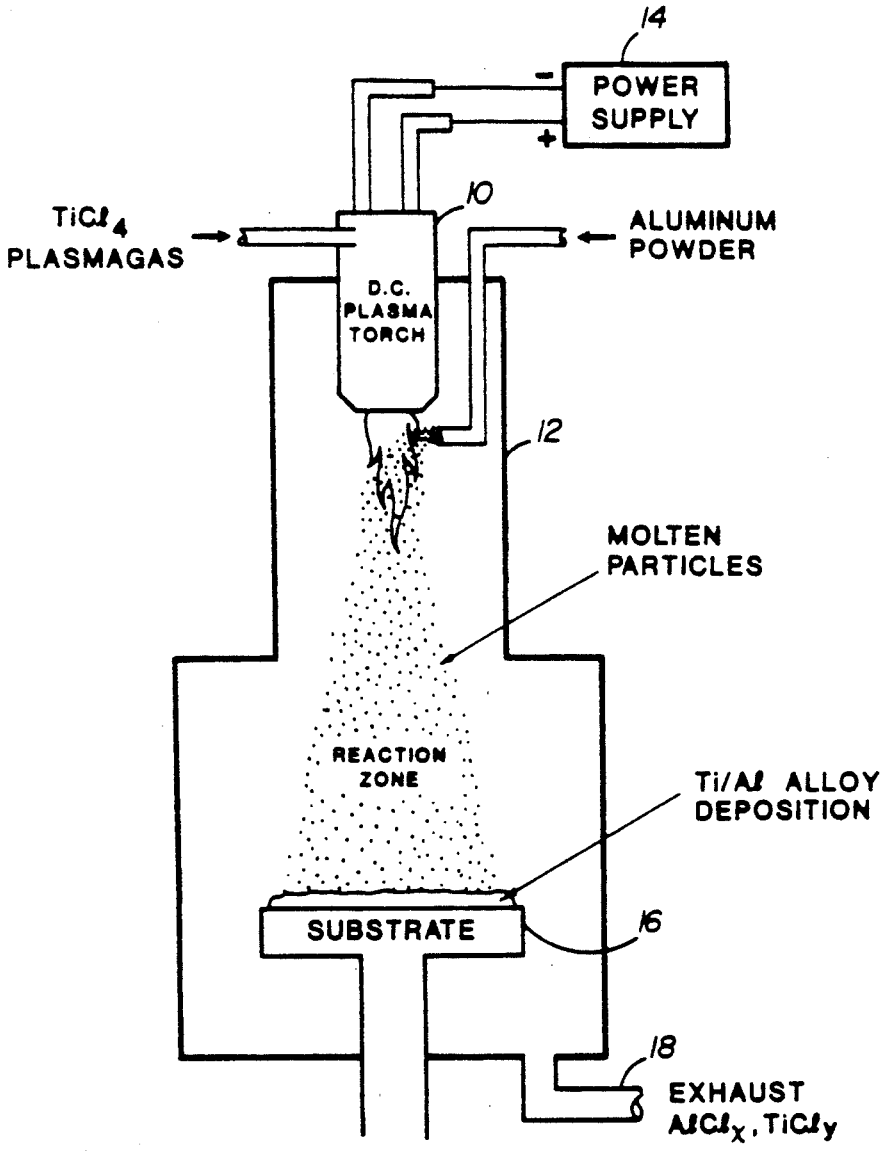
FIG. 1 illustrates one version of the spray forming process for the production of titanium aluminides using a d. c. plasma torch.

Referring to FIG. 1, a d.c. plasma torch 10 is mounted on a reactor 12. The torch is operated from a suitable d.c. power supply 14 to melt aluminum powder which is fed into the tail flame of the torch. The molten powder is reacted in flight with a $TiCl_4$ plasmagas fed to the plasma torch. By generating a molten spray of aluminum in a hot $TiCl_4$ environment, droplets of Ti-Al alloy are produced. The droplets are then deposited onto a cold substrate 16 where they freeze. Exhaust titanium and aluminum chloride gases escape from exhaust port 18.

An alternative option to that shown in FIG. 1 involves the generation of a molten aluminum spray in a d.c. torch through the use of aluminum as one of the electrodes. In this case the consumable aluminum electrode would melt and partially react with $TiCl_4$ within the torch. The plasmagas velocity would then generate a spray of Ti/Al alloy which would be directed towards the substrate. The reaction would be completed in flight.

Figure 2:
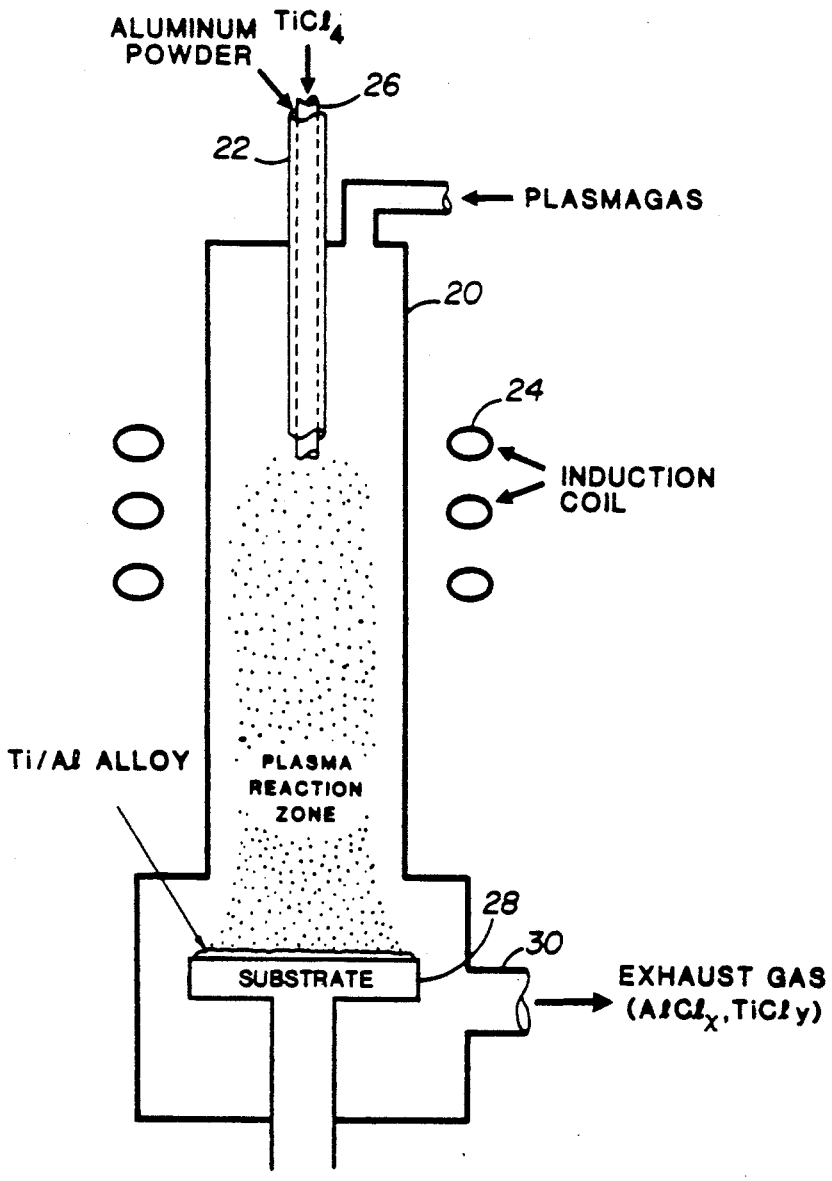
FIG. 2 illustrates a second version of the spray forming process for the production of titanium aluminides using an induction torch.

FIG. 2 illustrates a second variation of the process using an induction furnace 20 as a plasma generating device instead of a d.c. plasma torch. Aluminum powder which is introduced into the top of the furnace through outer tube 22 is melted by induction coil 24 and reacted with hot $TiCl_4$ vapor which is fed through inner tube 26, in the presence of an inert plasmagas. The droplets are deposited on a substrate 28. Exhaust titanium and aluminum chloride gases escape from exhaust port 30.

Figure 3:
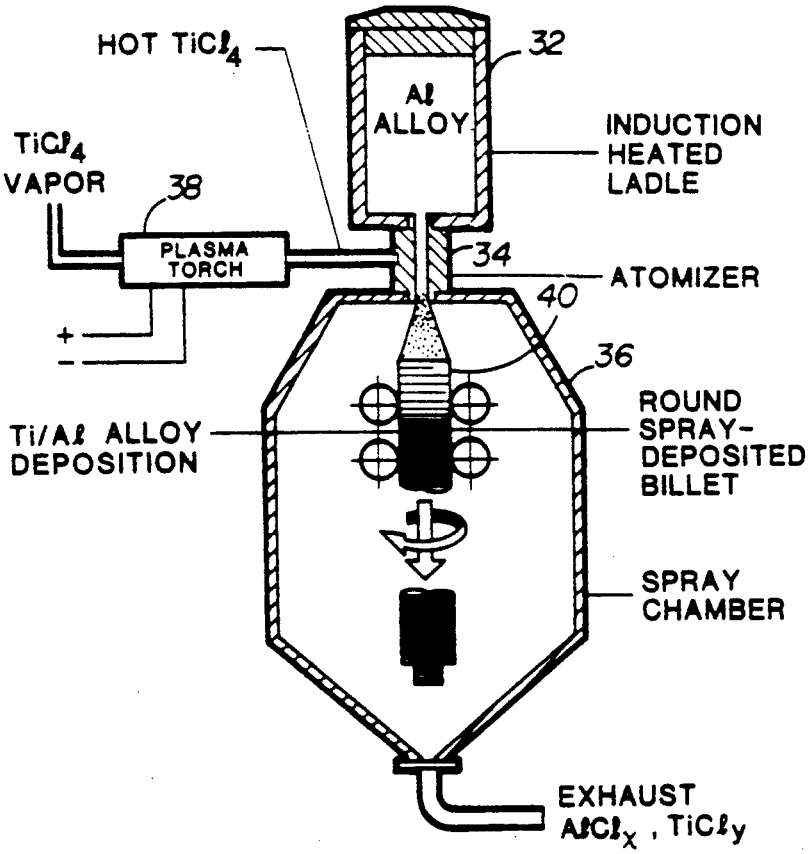
FIG. 3 illustrates a third version of the spray forming process for the production of titanium/aluminum alloys wherein the molten reactive spray is generated in a two-fluid atomizing nozzle.

FIG. 3 illustrates a third variation of the process wherein aluminum containing alloying components is melted in an induction heated ladle 32 and fed into a two-fluid atomizing nozzle 34 mounted on the top of a spray chamber 36. $TiCl_4$ vapor heated by a d.c. plasma torch 38 is fed as the second fluid into the atomizing nozzle. A Ti-Al alloy is deposited as a round billet. The exhaust titanium and aluminum chloride gases escape from exhaust port 42.

Movement of the substrate determines the shape of the final product in a manner similar to the one used in conventional spray-forming operations. The droplets can then be deposited into a moving cold substrate where they freeze to form a sheet, a billet, a tube or whatever other form is desired. If the substrate is completely removed from the reactor, the droplets will freeze in flight forming powders of the alloy. The powders can be collected at the bottom of the reactor. Even in the presence of a substrate, some powders are formed at the bottom of the reactor. The substrate collection efficiency is around 70%. The remaining 30% will be collected in the form of powders. By controlling the ratio of the feed materials, the reaction temperature, the flight (reaction) time of the droplets, and the temperature of the substrate a wide variety of alloys can be produced. Alloys of other reactive metals (vanadium, zirconium, hafnium, niobium, tantalum etc.) can be produced similarly. By changing the reaction chemistry, ceramic/metal composite materials can be produced in the reactive spray forming process. Minor alloying components (such as Ta, W, V, Nb, Mo, etc.) can be introduced either in the initial molten spray or in the reactive gas.

Titanium tetrachloride reacts readily with aluminum to form Ti/Al alloys and aluminum and titanium chlorides. At thermodynamic equilibrium, the composition of the products depends on the stoichiometry of the reactants and the reaction temperature. Three examples of equilibrium calculation based on a computer model are provided to demonstrate the possible product compositions.

| | |
|---|---|
| Example 1: | |
| Reactants Stoichiometry: | 1.0 mole $TiCl_4$ + 3.8 moles Al |
| Reactants Feed Temperature: | $TiCl_4$ = 4236 K.; Al = 298 K. |
| Reaction Pressure: | 1.0 atm |
| Deposition Temperature: | 1750 K. |
| Weight % Ti in Alloy: | 52.3% |
| Ti Recovery: | 97% |
| Exhaust Gas Composition: | 72% $AlCl_2$ |
| | 22% AlCl |
| | 5% $AlCl_3$ |
| | 1% $TiCl_2$ |
| Example 2: | |
| Reactants Stoichiometry: | 1.0 mole $TiCl_4$ + 2.8 moles Al |
| Reactant Feed Temperature: | $TiCl_4$ = 5926 K.; Al = 298 K. |
| Reaction Pressure: | 1.0 atm |
| Deposition Temperature: | 2300 K. |
| Weight % Ti in Alloy: | 64.2% |
| Ti Recovery: | 57% |
| Exhaust Gas Composition: | 50% AlCl |
| | 32% $AlCl_2$ |
| | 15% $TiCl_2$ |
| | 1% $TiCl_3$ |
| | 1% $AlCl_3$ |
| | 1% Al |
| Example 3: | |
| Reactants Stoichiometry: | 1.0 mole $TiCl_4$ + 3.2 moles Al |
| Reactant Feed Temperature: | $TiCl_4$ = 5461 K.; Al = 1200 K. |
| Deposition Temperature: | 2300 K. |
| Reaction Pressure: | 1.0 atm |
| Weight % Ti in Alloy: | 62.5% |
| Ti Recovery: | 70% |
| Exhaust Gas Composition: | 54% AlCl |
| | 32% $AlCl_2$ |
| | 10% $TiCl_2$ |
| | 1% $TiCl_3$ |
| | 1% $AlCl_3$ |
| | 1% Al |
| | 1% Cl |

As shown in the above three examples, a variety of Ti/Al alloys are possible from the reaction of $TiCl_4$ and Al. As the reaction temperature increases, the produce becomes increasingly concentrated in titanium. At relatively high temperatures, the aluminum chloride and titanium sub-chloride products are in their gaseous phase. Thus, the chlorides leave with the exhaust gas and only metal is collected on the substrate. The theoretical yield of titanium can be very high.

A variety of Ti/Al alloy samples have been produced using both the d.c. and the induction torches shown in FIGS. 1 and 2 of the drawings. Two examples are listed below:

| | |
|---|---|
| Example 1: | |
| Reactor Version Used: | d.c. torch with $TiCl_4$ gas and Al powder fed in tail flame |
| Plasmagas Feed Rate: | 60 L/min Argon |
| Aluminum Powder Feedrate: | 5 g/min |
| Powder Transport Gas: | 15 L/min Argon |
| $TiCl_4$ Vapor Feed Rate: | 10 g/min |
| Vapor Transport Gas: | 5 L/min Argon |
| Plasma Plate Power: | 20 kW |
| Duration of Experiment: | 12 min |

-continued

| | |
|---|---|
| Reactor Pressure | 760 torr |
| Injection Port - | |
| Substrate Distance: | 200 mm |
| Weight of Deposit: | 47 g |
| Weight % Ti in Alloy: | 39.3% |
| Example 2: | |
| Reactor Version Used: | Induction torch with $TiCl_4$ gas and Al powder fed in the plasma region |
| Plasmagas Feed Rate: | 109 L/min Argon and 6 L/min Hydrogen |
| Aluminum Powder Feedrate: | 4.8 g/min |
| Powder Transport Gas: | 5 L/min |
| $TiCl_4$ Vapor Feed Rate: | 8.3 g/min |
| Vapor Transport Gas: | 6 L/min |
| Plasma Plate Power: | 30 kW |
| Duration of Experiment: | 20 min |
| Reactor Pressure: | 580 torr |
| Injection Port - | |
| Substrate Distance: | 179 mm |
| Weight of Deposit: | 84.9 g |
| Weight % Ti in Alloy: | 18.9% |

The experimental results are in close agreement with theoretical analysis, suggesting that the reaction kinetics are extremely fast.

We claim:

1. A reactive plasma spray forming process comprising:

generating a hot metal halide plasma; and introducing a molten spray of a reducing metal into the halide plasma for reacting the said molten spray and the metal halide plasma to form a mixture of the molten metal and the metal of the halide molecule, where the mixture is an alloy, an intermetallic or a composite of a metal and an intermetallic.

2. A process as defined in claim 1, wherein the molten spray of metal is directed towards a cooled substrate and the alloy, intermetallic or composite product collected and solidified on the substrate.

3. A process as defined in claim 1, wherein the reacted molten product freezes in flight, and is collected as a powder.

4. A process as defined in 1, wherein a plasma torch fed with a plasmagas is used to generate the metal halide plasma and to produce the molten metal spray from either a molten metal stream or from a metal powder.

5. A process as defined in claim 4, wherein the plasma torch is an induction plasma torch and wherein a metal halide gas is injected in the plasmagas.

6. A process as defined in claim 4, wherein the plasma torch is a d.c. plasma torch and wherein a metal halide gas is introduced either in the plasmagas, or in the tailframe of the plasma torch.

7. A process as defined in claim 4, wherein a consumable electrode is used to generate the molten spray of metal.

8. A process as defined in claim 1, wherein a plasma torch is used to generate the metal halide plasma and wherein a two-fluid atomizing nozzle is used to introduce a molten metal into the metal halide plasma.

9. A process as defined in claim 8, wherein the molten metal and metal halide plasma are fed as the two fluids into the atomizer.

10. A process as defined in claim 9, wherein the atomizing nozzle is a two-fluid atomizing nozzle and wherein the heated metal halide gas is introduced into the two-fluid atomizing nozzle as one of the fluids and the molten metal is introduced into the two-fluid atomizing nozzle as the other fluid.

* * * * *

UNITED STATES PATENT AND TRADEMARK OFFICE

CERTIFICATE OF CORRECTION

PATENT NO.: 5,217,747
DATED : June 8, 1993
INVENTOR(S): Peter G. TSANTRIZOS et al.

It is certified that error appears in the above-identified patent and that said Letters Patent is hereby corrected as shown below:

Column 1, before line 1, insert --Background of the Invention;
1. Field of the Invention--; and
before line 4, insert --2. Description of the Related Art--.

Column 2, before line 49, insert --In the first version, aluminum powder is introduced into the tail flame of a d.c. torch. In the second version, aluminum powder is introduced into an induction plasma torch.--;

line 52, delete "injected in";
line 53, change "the tail flame of" to --heated by--; and
before line 63, insert --Brief Description of the Drawings--.

Column 3, before line 8, insert --Detailed Description of the Invention--.

Column 5,
Claim 1, line 3, delete "hot" and "and";
line 4, delete "a reducing", and after "metal", change "into" to --and--;
line 5, delete "the halide plasma for";
line 6, change "and" to --of metal in flight with--.

UNITED STATES PATENT AND TRADEMARK OFFICE

CERTIFICATE OF CORRECTION

PATENT NO.: 5,217,747
DATED : June 8, 1993
INVENTOR(S): Peter G. TSANTRIZOS et al.

It is certified that error appears in the above-identified patent and that said Letters Patent is hereby corrected as shown below:

Col. 6, Claim 2, line 3, change "product" to --is--.

Col. 6, Claim 3, lines 2-3, change "reacted molten product" to --mixture--.

Col. 6, Claim 4, line 2, delete "fed with a plasmagas--.
line 4, delete "either a molten metal stream or from".

Please cancel claim 5.

Col. 6, Claim 6, line 2, delete "and wherein a metal halide";
line 3, delete the entire line;
line 4, delete "frame of the plasma torch".

Please cancel claims 7-9.

Col. 6, Claim 10, line 1, change "claim 9" to --claim 12--.

Please add the following claims:

--11. A reactive plasma spray forming process comprising:
generating an inert plasma;
injecting a metal halide gas into the plasma to heat the metal halide gas;

UNITED STATES PATENT AND TRADEMARK OFFICE

CERTIFICATE OF CORRECTION

PATENT NO.: 5,217,747
DATED : June 8, 1993
INVENTOR(S): Peter G. TSANTRIZOS et al.

It is certified that error appears in the above-identified patent and that said Letters Patent is hereby corrected as shown below:

producing a molten spray of metal; and reacting the said molten spray of metal in flight with the heated metal halide gas to form a mixture of the molten metal and the metal of the halide molecule, where the mixture is an alloy, an intermetallic or a composite of a metal and an intermetallic.

12. A reactive plasma spray forming process comprising:

generating an inert plasma;

injecting a metal halide gas into the plasma to heat the metal halide gas;

introducing a molten metal into an atomizing nozzle to produce a molten spray of metal; and reacting the said molten spray of metal in flight with the heated metal halide gas to form a mixture of the molten metal and the metal halide of the halide molecule, where the mixture is an alloy, an intermetallic or a composite of a metal and an intermetallic.

13. A process as defined in claim 11, wherein a plasma torch is used to generate the inert plasma and to produce the molten spray of metal from a metal powder.

UNITED STATES PATENT AND TRADEMARK OFFICE

CERTIFICATE OF CORRECTION

PATENT NO. : 5,217,747

DATED : June 8, 1993

INVENTOR(S) : Peter G. Tsantrizos, et al.

It is certified that error appears in the above-indentified patent and that said Letters Patent is hereby corrected as shown below:

14. A process as defined in claim 13, wherein the plasma torch is an induction plasma torch.--

Signed and Sealed this

Eighteenth Day of April, 1995

Bruce Lehman

*Attest:*

BRUCE LEHMAN

*Commissioner of Patents and Trademarks*

*Attesting Officer*

UNITED STATES PATENT AND TRADEMARK OFFICE

CERTIFICATE OF CORRECTION

PATENT NO.: 5,217,747
DATED : June 8, 1993
INVENTOR(S): Peter G. TSANTRIZOS et al.

It is certified that error appears in the above-identified patent and that said Letters Patent is hereby corrected as shown below:

Column 1, before line 1, insert --Background of the Invention; 1. Field of the Invention--; and
before line 4, insert --2. Description of the Related Art--.

Column 2, before line 49, insert --In the first version, aluminum powder is introduced into the tail flame of a d.c. torch. In the second version, aluminum powder is introduced into an induction plasma torch.--;

line 52, delete "injected in";
line 53, change "the tail flame of" to --heated by--; and
before line 63, insert --Brief Description of the Drawings--.

Column 3, before line 8, insert --Detailed Description of the Invention--.

Column 5,
Claim 1, line 3, delete "hot" and "and";
line 4, delete "a reducing", and after "metal", change "into" to --and--;
line 5, delete "the halide plasma for";
line 6, change "and" to --of metal in flight with--.

UNITED STATES PATENT AND TRADEMARK OFFICE

CERTIFICATE OF CORRECTION

PATENT NO.: 5,217,747
DATED : June 8, 1993
INVENTOR(S): Peter G. TSANTRIZOS et al.

It is certified that error appears in the above-identified patent and that said Letters Patent is hereby corrected as shown below:

Col. 6, Claim 2, line 3, change "product" to --is--.

Col. 6, Claim 3, lines 2-3, change "reacted molten product" to --mixture--.

Col. 6, Claim 4, line 2, delete "fed with a plasmagas--.
line 4, delete "either a molten metal stream or from".

Please cancel claim 5.

Col. 6, Claim 6, line 2, delete "and wherein a metal halide";
line 3, delete the entire line;
line 4, delete "frame of the plasma torch".

Please cancel claims 7-9.

Col. 6, Claim 10, line 1, change "claim 9" to --claim 12--.

Please add the following claims:

--11. A reactive plasma spray forming process comprising:
generating an inert plasma;
injecting a metal halide gas into the plasma to heat the metal halide gas;

UNITED STATES PATENT AND TRADEMARK OFFICE

CERTIFICATE OF CORRECTION

PATENT NO.: 5,217,747
DATED : June 8, 1993
INVENTOR(S): Peter G. TSANTRIZOS et al.

It is certified that error appears in the above-identified patent and that said Letters Patent is hereby corrected as shown below:

producing a molten spray of metal; and reacting the said molten spray of metal in flight with the heated metal halide gas to form a mixture of the molten metal and the metal of the halide molecule, where the mixture is an alloy, an intermetallic or a composite of a metal and an intermetallic.

12. A reactive plasma spray forming process comprising:

generating an inert plasma;

injecting a metal halide gas into the plasma to heat the metal halide gas;

introducing a molten metal into an atomizing nozzle to produce a molten spray of metal; and reacting the said molten spray of metal in flight with the heated metal halide gas to form a mixture of the molten metal and the metal halide of the halide molecule, where the mixture is an alloy, an intermetallic or a composite of a metal and an intermetallic.

13. A process as defined in claim 11, wherein a plasma torch is used to generate the inert plasma and to produce the molten spray of metal from a metal powder.

UNITED STATES PATENT AND TRADEMARK OFFICE

CERTIFICATE OF CORRECTION

PATENT NO. : 5,217,747 Page 4 of 4

DATED : June 8, 1993

INVENTOR(S) : Peter G. Tsantrizos, et al.

It is certified that error appears in the above-indentified patent and that said Letters Patent is hereby corrected as shown below:

14. A process as defined in claim 13, wherein the plasma torch is an induction plasma torch.—

Column 2, above line 32, insert --Summary of the Invention--.

Column 5, claim 1, lines 3-4, "and introducing" should read --producing--.

This certificate supersedes Certificate of Correction issued April 18, 1995.

Signed and Sealed this

Eighteenth Day of July, 1995

*Attest:*

*Attesting Officer*

Bruce Lehman

BRUCE LEHMAN

*Commissioner of Patents and Trademarks*